US006661985B2

(12) United States Patent
Kiyohara et al.

(10) Patent No.: US 6,661,985 B2
(45) Date of Patent: Dec. 9, 2003

(54) ELECTROPHOTOGRAPHIC IMAGE BEARER, PROCESS CARTRIDGE AND IMAGE FORMING APPARATUS USING THE IMAGE BEARER

(75) Inventors: Takato Kiyohara, Mishima (JP); Kiyoshi Taniguchi, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 85 days.

(21) Appl. No.: 10/086,726

(22) Filed: Mar. 4, 2002

(65) Prior Publication Data

US 2003/0059232 A1 Mar. 27, 2003

(30) Foreign Application Priority Data

Mar. 5, 2001 (JP) ..... 2001-060790

(51) Int. Cl.[7] ..... G03G 15/00; G03G 21/00
(52) U.S. Cl. ..... 399/162
(58) Field of Search ..... 399/162

(56) References Cited

U.S. PATENT DOCUMENTS 4,046,473 A * 9/1977 Trainor ..... 399/162
4,077,713 A * 3/1978 Vercoulen ..... 399/162
4,375,330 A * 3/1983 Ophey ..... 399/162
4,663,258 A * 5/1987 Pai et al. ..... 399/162
4,711,562 A * 12/1987 Pothast et al. ..... 399/162
5,848,339 A * 12/1998 Costrop et al. ..... 399/162 X
6,421,513 B1 * 7/2002 Casella et al. ..... 399/162

FOREIGN PATENT DOCUMENTS

| | | | |
|---|---|---|---|
| JP | 55-89883 | * | 7/1980 |
| JP | 1-133086 | * | 5/1989 |
| JP | 6-118770 | | 4/1994 |
| JP | 6-342236 | | 12/1994 |
| JP | 8-179542 | | 7/1996 |
| JP | 8-202226 | | 8/1996 |
| JP | 8-248715 | | 9/1996 |
| JP | 9-50144 | | 2/1997 |
| JP | 9-81001 | | 3/1997 |
| JP | 9-90843 | | 4/1997 |
| JP | 10-254295 | * | 9/1998 |
| JP | 2000-19858 | * | 1/2000 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

An electrophotographic image bearing unit including a belt-form electrophotographic photoreceptor including an electroconductive substrate and a photosensitive layer located overlying the substrate and optionally a protective layer located overlying the photosensitive layer; and a pressing member which presses the photoreceptor while a surface of the pressing member contacts a surface of the photosensitive layer side of the photoreceptor such that the photoreceptor has a U-form portion, wherein the pressing member is rotated by the photoreceptor, wherein the surface of the photosensitive layer side of the photoreceptor has a static friction coefficient less than a static friction coefficient of the surface of the pressing member.

20 Claims, 4 Drawing Sheets

ELECTROPHOTOGRAPHIC IMAGE BEARER, PROCESS CARTRIDGE AND IMAGE FORMING APPARATUS USING THE IMAGE BEARER

BACKGROUND OF THE INVENTION

1. Field of the Invention

The present invention relates to an electrophotographic image bearer which can be used for electrophotographic image forming apparatus such as copiers, facsimile machines, laser printers and direct digital plate making machines. In addition, the present invention relates to a process cartridge and an image forming apparatus using the image bearer.

2. Discussion of the Background

Electrophotographic image forming processes typically include the following processes:

(1) charging an electrophotographic photoreceptor in a dark place (charging process);

(2) irradiating the charged photoreceptor with imagewise light to form an electrostatic latent image thereon (light irradiating process);

(3) developing the latent image with a developer including a toner mainly constituted of a colorant and a binder to form a toner image thereon (developing process);

(4) optionally transferring the toner image on an intermediate transfer medium (first transfer process);

(5) transferring the toner image onto a receiving material such as a receiving paper ((second) transfer process);

(6) heating the toner image to fix the toner image on the receiving material (fixing process); and (7) cleaning the surface of the photoreceptor after the toner image is transferred (cleaning process).

Recently, requisites for image forming apparatus using electrophotographic image forming processes, such as electrophotographic copiers and printers are as follows:

(1) being able to produce high quality images at a high speed;

(2) being small in size; and (3) having a long life.

The life of an image forming apparatus mainly depends on the life of the photoreceptor used therefor because the photoreceptor tends to be damaged when repeatedly suffers mechanical and chemical actions during the processes of charging, light irradiating, developing, transferring and cleaning. Mechanical actions cause photoreceptors to be abraded and hurt. Chemical actions such as oxidation reaction caused by ozone deteriorate the binder resins and charge transport materials included in the photoreceptors. In addition, as a result of chemical actions, depositions adhere on the surface of photoreceptors, and thereby image qualities deteriorate.

Since image forming apparatus are speeded up and minimized as mentioned above, the photoreceptors used therefor are also minimized. Therefore usage conditions of photoreceptors become severer and severer.

From this standpoint, there are proposals for belt photoreceptors and belt intermediate transfer materials. In order to minimize the belt photoreceptors, the peripheral length of the belt photoreceptor should be minimized. However, when the peripheral length is minimized, the surface of the belt photoreceptors frequently contacts various image forming members such as a cleaner, image developer and transferer, resulting in increase of abrasion of the photosensitive layer, and thereby the life of the photoreceptors is shortened.

As another way to minimize belt photoreceptors, image bearing members are proposed which have a construction such that the surface of the photosensitive layer side of a belt photoreceptor is pressed by a pressing member such that the photoreceptor has a U shape as illustrated in FIG. 3. However, such a belt photoreceptor (i.e., the photosensitive layer) are seriously abraded because the surface of the photosensitive layer side contacts the pressing member, and thereby the electrostatic properties of the photoreceptor are deteriorated. In addition, the photosensitive layer tends to be mechanically broken, resulting in shortage of the life of the photoreceptor.

Japanese Laid-Open Patent Publication No. (hereinafter referred to as JOP) 8-179542 discloses aprotective layer having good mechanical strength to improve the abrasion resistance of the photoreceptor. However, as a result of the present inventors' evaluation, the photoreceptor cannot produce high quality images because the resolution of the resultant images is deteriorated, namely the resultant character images are widened.

In order to reduce abrasion of the surface of photoreceptors, methods in which the friction coefficient of the surface of photoreceptors is reduced have been proposed. However, as a result of the present inventors' investigation, it is found that photoreceptors having a low friction coefficient do not necessarily have a good abrasion resistance, namely photoreceptors having a low friction coefficient are abraded depending on the pressing member used.

JOP8-248715 discloses an image forming apparatus in which the photoreceptor used has a friction coefficient in a specific range against the developing roller. JOP 6-118770 discloses an image forming apparatus in which the friction coefficient of the photoreceptor used is smaller than that of both end portions of the charging roller used. JOPs 9-50144 and 9-90843 have disclosed image forming apparatus in which the relationship between the friction coefficient of the surface of the photoreceptor used and the friction coefficient of the cleaner used is specified.

In addition, JOPs 6-342236, 8-202226 and 9-81001 have disclosed techniques in which a member applying a lubricant to the surface of the photoreceptor used is provided around the photoreceptor. However, needless to say, when such a member is provided in an image forming apparatus, the image forming apparatus becomes large in size (i.e., the image forming apparatus cannot be minimized).

Because of these reasons, a need exists for a belt-form photoreceptor which can be used for small image forming apparatus and which can produce images having good image qualities while having a long life and high reliability.

SUMMARY OF THE INVENTION

Accordingly, an object of the present invention is to provide an electrophotographic image bearer for small image forming apparatus, which has at least a belt-form photoreceptor and a pressing member pressing the surface of the photosensitive side of the photoreceptor and which can produce images having good image qualities while the photoreceptor has a long life and high reliability.

Briefly the object and other objects of the present invention as hereinafter will become more readily apparent can be attained by an image bearing unit including at least a belt-form electrophotographic photoreceptor including at least an electroconductive substrate and a photosensitive layer located overlying the substrate and a pressing member which presses the belt-form photoreceptor while a surface of the pressing member contacts a surface of the photosensitive layer side of the photoreceptor such that the photoreceptor has a U-form or V-form portion (hereinafter simply referred to as a U-form portion) and the pressing member is driven by (i.e., rotated together with) the belt-form photoreceptor, wherein the surface of the photosensitive layer side of the photoreceptor has a static friction coefficient less than a static friction coefficient of the surface of the pressing member.

The friction coefficient of the photosensitive layer side of the belt-form photoreceptor is preferably from 0.1 to 0.4.

The surface of the photosensitive layer side preferably has a pencil hardness of 3H or harder.

The photosensitive layer preferably includes a combination of a charge generation layer and a charge transport layer. The charge transport preferably includes a charge transport material and a binder resin, and more preferably an antioxidant is included therein. The thickness of the combination photosensitive layer is preferably from 10 $\mu$m to 30 $\mu$m.

The peripheral length and thickness of the belt-form photoreceptor is preferably from 100 mm to 5000 mm, and from 80 $\mu$m to 160 $\mu$m.

In another aspect of the present invention, an image forming apparatus is provided which includes an electrophotographic image bearer; a charger configured to charge the photoreceptor; a light irradiator configured to irradiate the photoreceptor with laser light to form an electrostatic latent image on the photoreceptor; an image developer configured to develop the latent image with a developer including a toner to form a toner image on the photoreceptor; and an image transferer configured to transfer the toner image onto a receiving material, wherein the image bearer is the electrophotographic image bearer of the present invention mentioned above.

In yet another aspect of the present invention, a process cartridge is provided which includes an image bearing unit, and at least one of a charger, an image irradiator, an image developer, an image transferer, a cleaner and a discharger, wherein the image bearer is the electrophotographic image bearer of the present invention mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

As a result of the present inventors' investigation, it is found that in an electrophotographic image forming apparatus having an image bearer including at least a belt-form photoreceptor and a pressing member which is driven by (rotated together with) the photoreceptor and presses the surface of the belt-form photoreceptor such that the belt-form photoreceptor has a U-form portion, the surface of the photoreceptor is abraded when the pressing member is rotated at the same speed as that of the photoreceptor.

In addition, it is found that when the friction coefficient of the photoreceptor is lower than that of the surface of the pressing member, the pressing member is well driven by the photoreceptor, and thereby the abrasion quantity of the surface of the photoreceptor can be reduced. Thus, the life of the photoreceptor can be prolonged.

Further, it is found that when the surface of the belt-form photoreceptor has a static friction coefficient of from 0.1 to 0.4, the abrasion quantity of the surface of the photoreceptor can be further reduced. In addition, when the surface of the photoreceptor has a pencil hardness of 3H or harder, the abrasion quantity of the surface of the photoreceptor can be further reduced.

In the present invention, the pencil hardness is measured based on JIS K5400-1990. The pencil hardness of a surface is defined as the hardness of the hardest pencil among the pencils by which the surface is broken at a rate less than 2/5.

Figure 5:
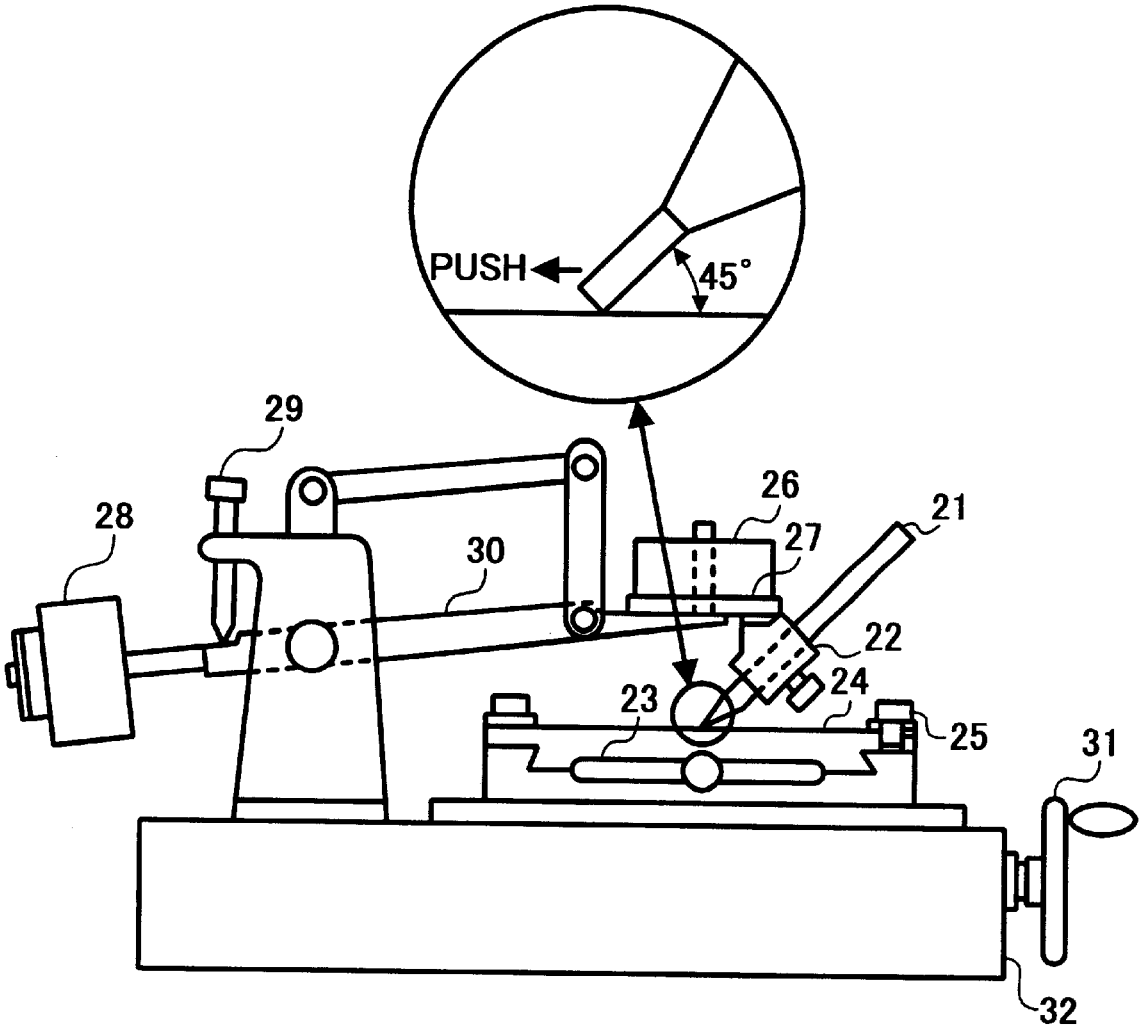
FIG. 5 is a schematic view illustrating an embodiment of the instrument of measuring the pencil hardness for use in the present invention.

The method of measuring the pencil hardness (i.e., JIS K5400-1990) will be explained referring to FIG. 5.

The strength of a coated film is determined using a method using a pencil scratching tester or a hand testing method. The method using a pencil scratching tester is explained referring to FIG. 5. In FIG. 5, numerals 21 and 22 denote a pencil and a pencil holder, respectively. Numerals 23, 24 and 25 denote a table on which a test piece is set, the test piece, and a fixer fixing the test piece on the table, respectively. Numerals 26, 27, 28, 29 and 30 denote a weight (1.00±0.05 kg), a weight table on which the weight is set, a balancing weight, a setscrew, and a shaft, respectively. Numerals 31 and 32 denote a handle by which the table on which the test piece is set is moved, and a bed of the instrument, respectively.

As the pencil, pencils which are prescribed in JIS S6006 are used. The hardness of the pencils used is from 9H (hardest) to 6B (softest). The wood portion of an edge of a pencil is removed to expose the lead by about 3 mm. The edge of the lead is abraded by an abrasive paper (#400) while the lead perpendicularly contacts the abrasive paper and describes circles to prepare a lead having a smooth surface and a sharp edge.

A test piece is subjected to the test at a time about one or more hours after the preparation of the film.

Test procedure is as follows:

(a) a test piece 24 is set on the table 23 such that the surface to be tested is upward;

(b) a pencil 21 is set with the pencil holder 22 such that the edge of the pencil 21 is on the vertical line passing the gravity center of the weight 26;

(c) the position of the balancing weight 28 is adjusted such that the load applied to the pencil 21 is 0, and then the shaft 30 is fixed by the setscrew 29 such that the pencil 21 does not contact the surface of the test piece 24;

(d) the weight 26 is set on the weight table 27, and then the setscrew 29 is loosened to contact the edge of the pencil 21 with the test piece 24 while a load of 1.00 kg is applied to the edge of the pencil;

(e) the handle 31 is rotated at a constant speed such that the test piece 24 is moved in the right hand direction by about 3 mm at a speed of 0.5 mm/sec;

(f) the measurements are performed 5 times while the scratching portion of the test piece is changed and the edge of the pencil is abraded; and (g) the operations (a) to (f) are repeated except that the pencil (hardness) is changed.

The hardness of a surface of the test piece is defined as the hardness of the hardest pencil among the pencils by which the surface of the film is broken at a rate less than 2/5. Namely, for example, the test result is the following, the pencil hardness of the sample is determined as H.

| | ← (harder) Pencil used for scratching (softer) → | | | | | | | |
|---|---|---|---|---|---|---|---|---|
| | 3H | 2H | H | F | HB | B | 2B | 3B |
| Film breaking rate | 5/5 | 2/5 | 1/5 | 0/5 | 0/5 | 0/5 | 0/5 | 0/5 |

The photoreceptor of the present invention will be explained referring to drawings.

Figure 1:
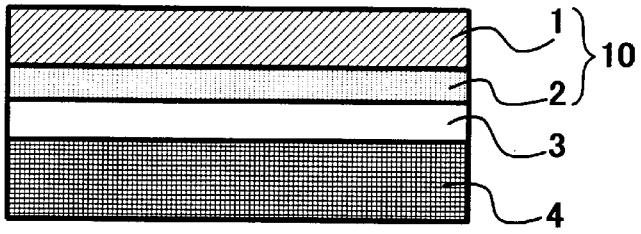
FIG. 1 is a schematic view illustrating the cross section of an embodiment of the electrostatic image bearer of the present invention.

FIG. 1 is a schematic view illustrating the cross section of an embodiment of the photoreceptor of the present invention.

In FIG. 1, an undercoat layer 3, a charge generation layer 2, and a charge transport layer 1 are formed on an electroconductive substrate 4 in this order. The structure of the photoreceptor of the present invention is not limited thereto. For example, a protective layer is formed overlying the charge transport layer 1. In the present invention the charge generation layer 2 and charge transport layer 1 are sometimes referred to as a photosensitive layer 10.

Suitable materials for use as the substrate 4 include electroconductive materials and insulating materials which are subjected to an electroconductive treatment. Specific examples of the substrate 4 include plates or belts made of (or including) a metal such as Al, Fe, Cu, and Au or a metal alloy thereof; materials in which an electroconductive thin layer of a metal such as Al, Ag and Au or a conductive material such as $In_2O_3$ and $SnO_2$ is formed on an insulating plate or film substrate such as polyester resins, polycarbonate resins, polyimide resins, and glass; and paper which is subjected to electroconductive treatment. The size of the substrate 4 is not particularly limited, but the peripheral length and thickness of the substrate 4 are preferably from 100 mm to 5000 mm and from 70 $\mu$m to 160 $\mu$m, respectively. The thickness is more preferably from 80 $\mu$m to 160 $\mu$m, and even more preferably from 80 $\mu$m to 130 $\mu$m.

In the photoreceptor of the present invention, the undercoat layer 3 is formed between the electroconductive substrate 4 and the photosensitive layer 10 (i.e., a combination of the charge generation layer 2 and charge transport layer 1), for example, to improve the adhesion of the photosensitive layer 10 to the substrate 4, to prevent moire in the resultant image, to improve the coating quality of the upper layer (i.e., to form a uniform photosensitive layer of the charge generation layer 2), and to decrease the residual potential of the resultant photoreceptor.

The undercoat layer 3 includes a resin as amain component. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and sodium polyacrylate; alcohol-soluble resins such as nylon copolymers, and methoxymethylated nylons; and crosslinkable resins, which form a three dimensional network, such as polyurethane resins, melamine resins, alkyd-melamine resins, and epoxy resins.

In addition, the undercoat layer 3 may include a fine powder such as metal oxides (e.g., titanium oxide, silica, alumina, zirconium oxide, tin oxide, and indium oxide), metal sulfides, and metal nitrides. When the undercoat layer 3 is formed using these materials, known coating methods using a proper solvent can be used.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, can also be preferably used as the undercoat layer.

The thickness of the undercoat layer 5 is preferably from 0 to 5 $\mu$m.

Next, the photosensitive layer 10 will be explained.

As the photosensitive layer, known photosensitive layers such as inorganic photosensitive layers including an inorganic photosensitive material such as selenium, and organic photosensitive layers including an organic photosensitive material such as organic photoconductive materials (i.e., OPCs) can be used. However, photoreceptors having a charge generation layer and a charge transport layer are preferably used in the present invention.

The photoreceptor having a charge generation layer and a charge transport layer will be explained in detail.

At first, the charge generation 2 layer will be explained. The charge generation layer 2 is mainly constituted of a charge generation material, and optionally includes a binder resin. Suitable charge generation materials include inorganic charge generation materials and organic charge generation materials.

Specific examples of the inorganic charge generation materials include crystalline selenium, amorphous selenium, selenium-tellurium alloys, selenium-tellurium-halogen alloys, selenium-arsenic alloys and amorphous silicon. Suitable amorphous silicon includes ones in which a dangling bond is terminated with a hydrogen atom or a halogen atom, or in which a boron atom or a phosphorus atom is doped.

Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials.

These charge transport materials can be used alone or in combination.

Specific examples of the binder resin, which is optionally included in the charge generation layer 2, include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

One or more charge transport materials may be included in the charge generation layer 2, if desired. In addition, one or more charge transport polymer materials can be used as a binder resin of the charge generation layer 2.

Suitable methods for forming the charge generation layer 2 include thin film forming methods in a vacuum, and casting methods.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer 2 include, for example, the following steps:

(1) preparing a coating liquid by mixing one or more inorganic or organic charge generation materials mentioned above with a solvent such as tetrahydrofuran, cyclohexanone, dioxane, butanone and the like, and if necessary, together with a binder resin and an additive, and then dispersing the materials with a ball mill, an attritor, a sand mill or the like;

(2) coating on a substrate the coating liquid, which is diluted if necessary, by a dip coating method, a spray coating method, a bead coating method, or the like method; and (3) drying the coated liquid to form a charge generation layer.

The thickness of the charge generation layer 2 is preferably from about 0.01 $\mu$m to about 5 $\mu$m, and more preferably from about 0.05 $\mu$m to about 2 $\mu$m.

Next, the charge transport layer 1 will be explained in detail.

The function of the charge transport layer 1 is to retain charges formed on the photosensitive layer, and to transport the carriers, which are selectively generated in the charge generation layer 2 by irradiating the photosensitive layer with imagewise light, to couple the carriers with the charges on the photosensitive layer, resulting in formation of an electrostatic latent image on the surface of the photoreceptor. Therefore, the charge transport layer 1 preferably has a high electric resistance to retain charges, and a small dielectric constant and a large charge mobility to obtain a high surface potential at the charges retained on the photosensitive layer.

In order to satisfy such requirements, the charge transport layer is mainly constituted of a charge transport material together with a binder resin (polycarbonate resin). The charge transport layer 1 is typically prepared as follows:

(1) a charge transport material, a binder resin (e.g., a polycarbonate resin) and an additive (if desired) are dissolved or dispersed in a solvent such as tetrahydrofuran to prepare a coating liquid; and (2) coating the coating liquid, for example, on the charge generation layer and then drying the coated liquid, resulting in formation of a charge transport layer 1.

The charge transport layer 1 may include an additive such as plasticizers, antioxidants, leveling agents etc., in an amount such that these agents do not deteriorate the characteristics of the charge transport layer 1.

In addition, solvents which do not include a halogen atom can be added to the coating liquid. Specific examples of such solvents include dioxane, xylene, toluene, methyl ethyl ketone, cyclohexanone etc.

The charge transport materials are classified into positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of the positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, $\alpha$-phenylstilbene derivatives, thiazole derivatives, triazole derivatives, phenazine derivatives, acridine derivatives, benzofuran derivatives, benzimidazole derivatives, thiophene derivatives, and the like materials. These positive hole transport materials can be used alone or in combination.

As the charge transport polymer material, the following charge transport polymers (i.e., polymers having an electron donating group) can be used:

(A) Polymers Having a Carbazole Ring in Their Main Chain and/or Side Chain

Specific examples of such polymers include poly-N-vinyl carbazole, and compounds disclosed in Japanese Laid-Open Patent Publications Nos. 50-82056, 54-9632, 54-11737, 4-175337, 4-183719 and 6-234841.

(B) Polymers Having a Hydrazone Skeleton in Their Main Chain and/or Side Chain

Specific examples of such polymers include compounds disclosed in Japanese Laid-Open Patent Publications Nos. 57-78402, 61-20953, 61-296358, 1-134456, 1-179164, 3-180851, 3-180852, 3-50555, 5-310904 and 6-234840.

(C) Polysilylene Compounds

Specific examples of such polymers include polysilylene compounds disclosed in Japanese Laid-Open Patent Publications Nos. 63-285552, 1-88461, 4-264130, 4-264131, 4-264132, 4-264133 and 4-289867.

(D) Polymers Having a Triaryl Amine Skeleton In Their Main Chain and/or Side Chain Specific examples of such polymers include N,N-bis(4-methylphenyl)-4-aminopolystyrene, and compounds disclosed in Japanese Laid-Open Patent Publications Nos. 1-134457, 2-282264, 2-304452, 4-133065, 4-133066, 5-40350 and 5-202135.

(E) Other Polymers

Specific examples of such polymers include condensation products of nitropyrene with formaldehyde, and compounds disclosed in Japanese Laid-Open Patent Publications Nos. 51-73888, 56-150749, 6-234836 and 6-234837.

The charge transport polymer material (the polymer having an electron donating group) for use in the charge transport layer 3 is not limited thereto, and known copolymers (random, block and graft copolymers) of the polymers with one or more known monomers and star polymers can also be used. In addition, crosslinking polymers having an electron donating group disclosed in, for example, Japanese Laid-Open Patent Publication No. 3-109406 can also be used.

Among these charge transport polymer materials, polycarbonates, polyurethanes, polyesters and polyethers, which have a triaryl amine structure are preferable. Specific examples of such polymer materials have been disclosed in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

Suitable polycarbonate resins include bisphenol A type, bisphenol Z type, bisphenol C type, bisphenol ZC type polycarbonate resins and the like. Polyacrbonate resins for use in the photosensitive layer are not limited thereto, and anypolycarbonate resins having abisphenol skeleton can be used. These polycarbonate resins can be used alone or in combination. In addition, these polycarbonate resins can be used in combination with resins other than polycarbonate resins.

The thickness of the charge transport layer 1 is preferably from 5 to 100 μm, and more preferably 10 to 22 μm.

The charge transport layer 1 may include an antioxidant and plasticizers which are used, for example, in rubbers, plastics, oils and fats.

In addition, the charge transport layer 1 may include a leveling agent. Specific examples of such leveling agents include silicone oils such as dimethyl silicone oils and methylphenyl silicone oils; and polymers and oligomers having a perfluoroalkyl group in their side chain. The content of the leveling agent is from 0 to 1 part by weight per 100 parts by weight of the binder resin included in the charge transport layer 3.

The charge transport layer may include an antioxidant. Specific examples of the antioxidant are as follows.

(A) Monophenol Compounds 2,6-di-t-butyl-p-cresol, butylated hydroxyanisole, 2,6-di-t-butyl-4-ethylphenol, stearyl-β-(3',5'-di-t-butyl-4-hydroxyphenol)propionate, etc.

(B) Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), etc.

(C) Polyphenol Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

(D) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(E) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(F) Organic Sulfur-Containing Compounds dilauryl-3,3'-thiodipropionate, distearyl-3,3'-thiodipropionate, ditetradecyl-3,3'-thiodipropionate, etc.

(G) Organic Phosphorus-containing Compounds triphenylphosphine, tri(nonylphenyl)phosphine, tri (dinonylphenyl)phosphine, tricresylphosphine, tri(2,4-dibutylphenoxy)phosphine, etc.

Next, the protective layer will be explained in detail.

The protective layer is formed overlying the photosensitive layer to protect the photosensitive layer. In addition, the protective layer preferably has good abrasion resistance to impart good mechanical durability to the resultant photoreceptor.

The protective layer mainly includes a binder resin and a filler dispersed in the binder resin.

Specific examples of the fillers include inorganic fillers and organic fillers.

Specific examples of the organic fillers include powders of fluorine-containing resins such as polytetrafluoroethylene, silicone resin powders, amorphous carbon powders, etc. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin, and potassium titanate. Among these fillers, inorganic fillers are preferably used in view of hardness. In particular, silica, titanium oxide and alumina are preferably used. These fillers can be used alone or in combination.

The surface of these fillers may be treated with one or more organic materials or inorganic materials to improve their dispersibility in the binder resin used. Specific examples of such organic materials include silane coupling agents, fluorine-containing silane coupling agents, and higher fatty acids. Specific examples of such inorganic materials include alumina, zirconia, tin oxide and silica.

The filler is preferably pulverized and dispersed in a binder resin using a ball mill, a sand mill, a vibrating mill or the like dispersing machine. Suitable binder resins include acrylic resins, polyester resins, polycarbonate resins, polyamide resins, polyurethane resins, polystyrene resins, and epoxy resins. In particular, polycarbonate resins are preferable.

The average particle diameter of the filler in the dispersion is preferably from 0.05 μm to 1.0 μm and more preferably from 0.05 μm to 0.8 μm. When the average particle diameter is too large, the particles project from the surface of the protective layer, and thereby a cleaning blade which scrapes the surface of the protective layer to remove residual toner particles tends to be damaged, resulting in insufficient cleaning of the photoreceptor.

The content of the filler in the protective layer is from 5 to 50% by weight, and preferably from 10 to 40% by weight based on total weight of the protective layer.

The more the concentration of the filler included in the protective layer, the better the abrasion resistance of the protective layer. However, when the concentration is too high, adverse affects are caused such that residual potential increases and the transmittance of the protective layer against the light used for writing images deteriorates. When the content of the filler is too low, the abrasion resistance is not satisfactory.

The protective layer is formed by any known coating method. In particular, spray coating methods, dipping coating methods, and bead coating methods are preferably used.

The total thickness of the photosensitive layer and the protective layer is preferably 10 μm to 30 μm, and more preferably from 10 μm to 25 μm. The thickness of the protective layer is preferably from 0.1 μm to 5 μm.

The protective layer may include a charge transport material to have a charge transport ability. Specific examples of the charge transport materials include the charge transport materials mentioned above for use in the charge transport layer.

The photoreceptor of the present invention can be used for typical electrophotographic image forming apparatus.

The friction coefficient and hardness of the surface of the photoreceptor can be controlled so as to be fall into the preferable ranges mentioned above by properly selecting the materials used in the uppermost layer of the photoreceptor, such as resins, fillers and additives. The friction coefficient of the surface of the photoreceptor is preferably from 0.1 to 0.4. In order to achieve such a friction coefficient, silicone oils such as dimethyl silicone oils and methyl phenyl silicone oils can be preferably included in the uppermost layer. Alternatively, fillers may be added in the uppermost layer.

The hardness of the surface of the photoreceptor can also be controlledby adjusting the addition amounts of the materials used therefor, such as resins, fillers and additives.

Next, an image forming apparatus of the present invention will be explained in detail.

Figure 2:
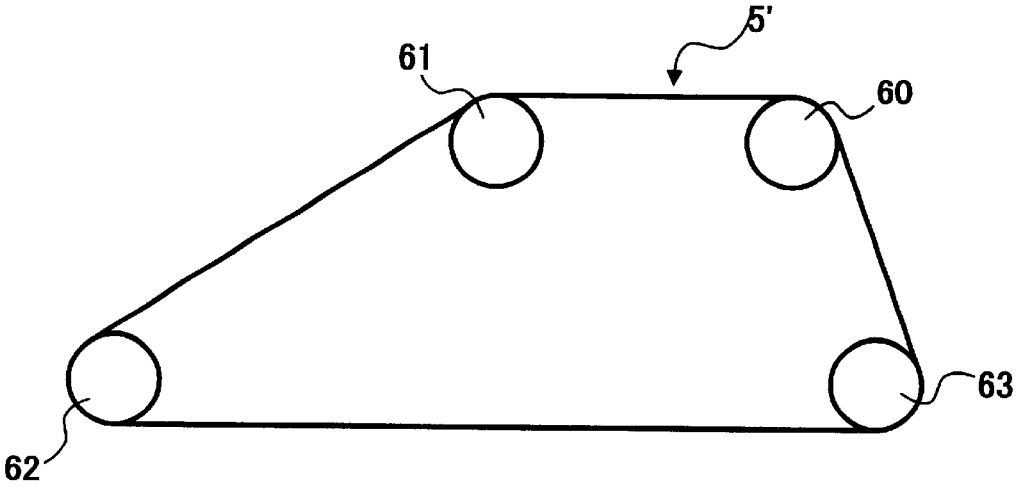
FIG. 2 BACKGROUND ART
FIG. 2 is a schematic view illustrating an electrophotographic image bearer of background image forming apparatus.

FIG. 2 is a schematic view illustrating a background belt photoreceptor set in an electrophotographic image forming apparatus. An endless belt photoreceptor 5' is wound around driving and driven rollers 60, 61, 62 and 63 while supported and driven by the rollers 60, 61, 62 and 63. The substrate 4 of the endless belt photoreceptor 5' is rotated while contacting the rollers 60, 61, 62 and 63.

The photoreceptor 5' is subjected to electrophotographic image forming processes. Namely, the photoreceptor 5' is charged and exposed to imagewise light to form an electrostatic latent image on the surface thereof. The latent image is then developed with a developer including a toner to form a toner image on the photoreceptor. The toner image is transferred on a receiving material and then fixed by a fixer. Thus a copy is provided. The surface of the photoreceptor 5' is typically cleaned by a cleaner to remove residual toners from the surface of the photoreceptor 5' after the toner image is transferrd.

Figure 3:
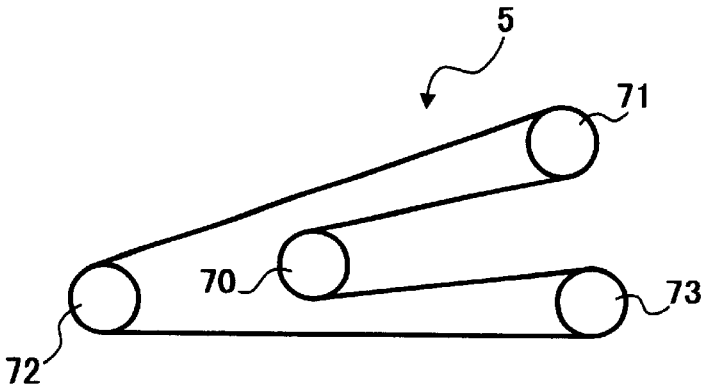
FIG. 3 is a schematic view illustrating an embodiment of the electrophotographic image bearer of the present invention.

FIG. 3 is a schematic view illustrating an embodiment of the image bearer of the present invention. An endless belt photoreceptor 5 is wound around driving and driven rollers 71, 72 and 73. A pressing roller (driven roller) 70 press the endless belt photoreceptor 5 while contacting the surface of the photosensitive layer side of the photoreceptor 5 such that the photoreceptor at least has a U-form portion. The roller 70 is rotated together with (i.e., driven by) the endless photoreceptor 5.

The photoreceptor 5 is also subjected to electrophotographic image forming processes mentioned above. Since the photoreceptor 5 having such a configuration is provided in the image forming apparatus of the present invention, the size of the image forming apparatus can be minimized while the length of the photoreceptor is almost the same as that of the photoreceptor 5' as shown in FIG. 2.

Figure 6:
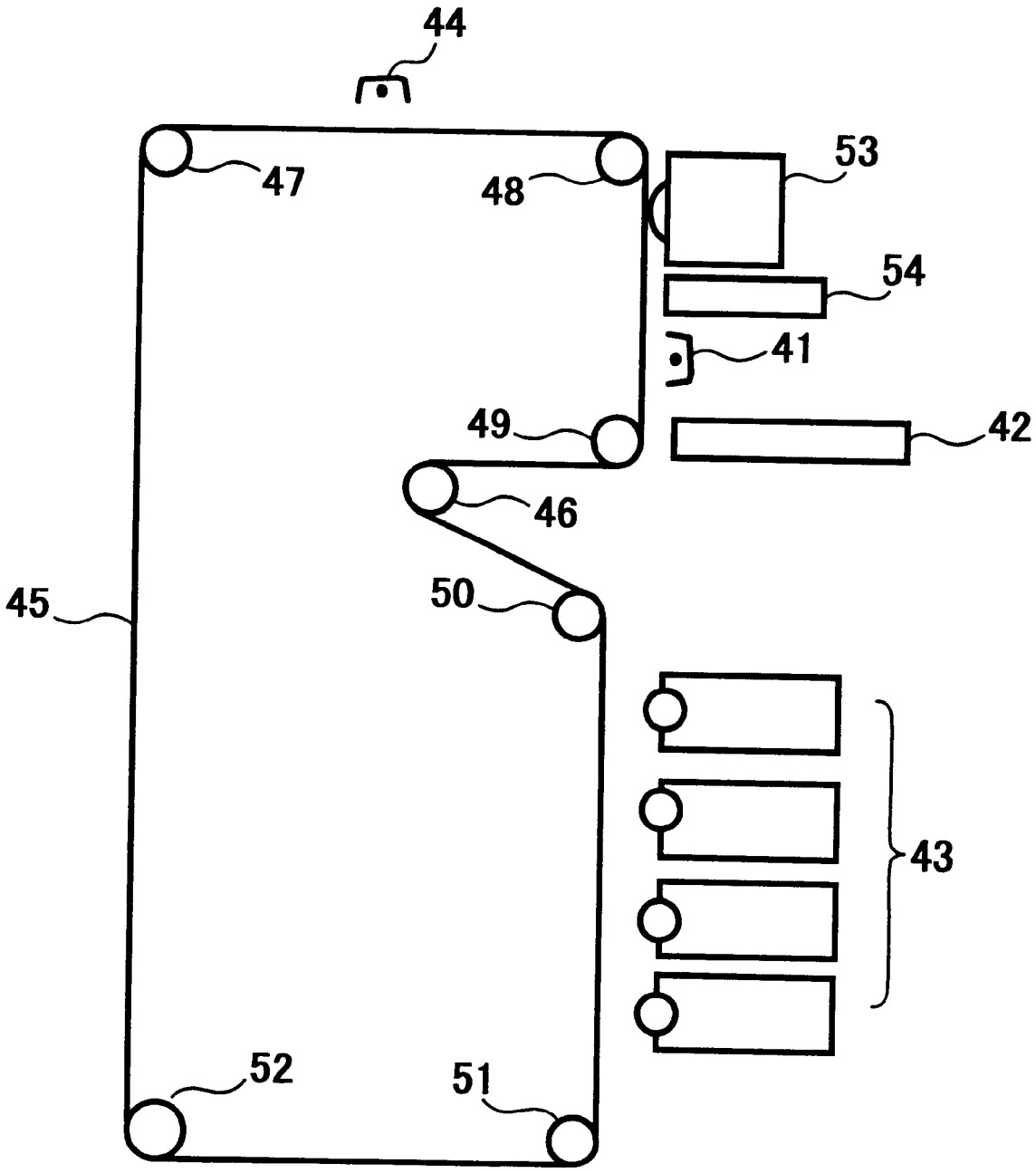
FIG. 6 is a schematic view illustrating an embodiment of the image forming apparatus of the present invention.

FIG. 6 is a schematic view illustrating an embodiment of the image forming apparatus of the present invention.

In FIG. 6, a belt-form photoreceptor 45 is the photoreceptor of the present invention. The belt form-photoreceptor 45 is rotated while supported by plural rollers 47, 48, 49, 50, 51 and 52, each of which is a drive, driven or tension roller, and a pressing member 46. The driven rollers may serve as a tension roller. The width of the contact area of the photoreceptor 45 with the rollers 47, 48, 49, 50, 51 and 52 and the pressing member 46 is longer than the width of the image forming area of the photoreceptor 45 but shorter than the width of the photoreceptor 45.

Numeral 41 denotes a charger configured to charge the photoreceptor 45. Numeral 42 irradiates the charged photoreceptor with a light beam to form an electrostatic latent image thereon. The latent image is developed with an image developing unit 43 having four color image developing sections (for example, yellow, magenta, cyan and black image developing sections) to form a toner image thereon. The toner image is then transferred on a receiving material using a transfer charger 44 configured to charge a receiving material. Suitable devices for use in the charger 41 and transfer charger 44 include known chargers such as corotrons, scorotrons, solid state chargers and charging rollers.

When a full color image is formed, a color toner image (such as a yellow, magenta, cyan toner image, or a black toner image) formed on the photoreceptor 45 is transferred on a receiving material one by one. Alternatively, a color toner image of the photoreceptor 45 is transferred on an intermediate transfer medium (not shown) one by one to form a full color toner image on the intermediate transfer medium, and then the full color toner image is transferred on a receiving material.

Suitable light sources for use in the image irradiator 42 and a discharging lamp 54, which irradiates the photoreceptor with light to discharge the residual potential of the photoreceptor, include fluorescent lamps, tungsten lamps, halogen lamps, mercury lamps, sodium lamps, light emitting diodes (LEDs), laser diodes (LDs), light sources using electroluminescence (EL), and the like. Among these light sources, laser diodes are preferably used. In addition, in order to obtain light having adesired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 6, but also other processes using light irradiation, such as a transfer process including light irradiation, a discharging process, a cleaning process including light irradiation and a pre-exposure process.

When the toner image formed on the photoreceptor 45 by the image developing unit 43 is transferred onto a receiving paper, all of the toner image are not transferred on the receiving paper, and residual toner particles remain on the surface of the photoreceptor 45. The residual toner may be removed from the photoreceptor 45 by a cleaner 53. As the cleaner, cleaning blades, cleaning brushes and combination of a cleaning brush with a cleaning blade can be typically used. In addition, cleaning can be performed by a magnetic brush. In this case, a magnetic brush used in the charger and image developing unit can be used as the cleaner.

When the photoreceptor 45 which is previously charged positively (or negatively) is exposed to imagewise light, an electrostatic latent image having a positive (or negative) charge is formed on the photoreceptor 45. When the latent image having a positive (or negative) charge is developed with a toner having a negative (or positive) charge, a positive toner image can be formed on the photoreceptor 45. In contrast, when the latent image having a positive (negative) charge is developed with a toner having a positive (negative) charge, a negative toner image (i.e., a reversal image) can be formed on the photoreceptor 45. As the developing device, known developing devices can be used. In addition, as the discharging devices, known discharging devices can also be used.

Specific examples of the pressing member include rubber rollers, metal rollers, etc. The driven means preferable have a surface having a friction coefficient of from 0.1 to 0.4. Among these means, metal rollers are preferably used because the friction coefficient can be easily obtained and dust tends not to adhere thereon.

The image bearer of the present invention may be fixedly set in an image forming apparatus such as copiers, facsimile machines, printers, etc. However, the image bearer can be set in an image forming apparatus as a process cartridge.

The process cartridge is a unit including at least the image bearer of the present invention. In addition, the process cartridge includes one or more of a charger, an image irradiator, an image developing unit, an image transferer, a cleaner and a discharger (e.g., adischarging lamp). The process cartridge can be easily attached to an image forming apparatus and detached therefrom.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Electroconductive Substrate

An aluminum layer having a thickness of 1000 Å was formed on one side of a 75 μm thick polyethyleneterephthalate film of 500 mm in width and 200 m in length using a vacuum vapor deposition method.

Formation of Undercoat Layer

The following components were mixed to prepare an undercoat layer coating liquid.

Alkyd resin (tradenamed as BEKKOZOL 1307-60-EL and manufactured by Dainippon Ink & Chemicals, Inc.) 6

Melamine resin (tradenamed as SUPER BEKKAMIN G-821-60 and manufactured by Dainippon Ink & Chemicals, Inc.) 4

Titanium oxide 40

Methyl ethyl ketone 200

The undercoat layer coating liquid was coated on the aluminum layer of the polyethyleneterephthalate film prepared above by a roller coating method, and then dried. Thus, an undercoat layer having a thickness of 3 μm was formed on the aluminum layer.

Formation of Charge Generation Layer

The following components were mixed to prepare a charge generation layer coating liquid.

Bisazo pigment having the following formula (1) 5

(1)

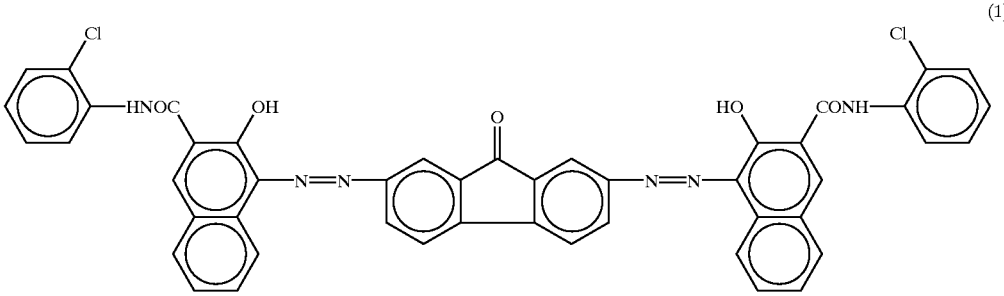

| | |
|---|---|
| Polyvinyl butyral | 5 |
| Cyclohexanone | 200 |
| Methyl ethyl ketone | 200 |

The charge generation layer coating liquid was coated on the undercoat layer by a roller coating method and then heated to dry the coated liquid. Thus a charge generation layer having a thickness of 0.2 μm was formed on the undercoat layer.

Formation of Charge Transport Layer

The following components were mixed to prepare a charge transport layer coating liquid.

| | |
|---|---|
| Bisphenol Z type polycarbonate | 10 |
| Charge transport material having the following formula (2) | 7 |

(2)

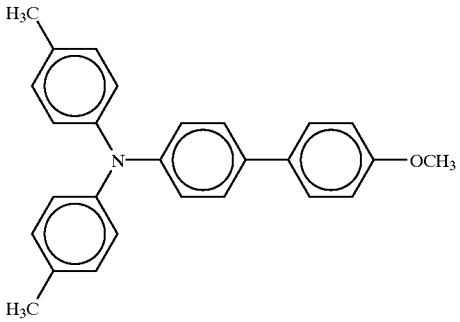

| | |
|---|---|
| Tetrahydrofuran | 80 |
| Silicone oil | 0.0001 |

The charge transport layer coating liquid was coated on the charge generation layer by a nozzle coating method, and then heated to dry the coated liquid. Thus, a charge transport layer having a thickness of 20 μm was formed on the charge generation layer.

Formation of Electroconductive Layer

The following components were mixed to prepare an electroconductive layer coating liquid.

| | |
|---|---|
| Polycarbonate resin | 10 |
| Carbon black | 3 |
| Graphite | 5 |
| Tetrahydrofuran | 80 |

The electroconductive layer coating liquid was coated on the both edges (having a length of 200 m) of the charge transport layer by a nozzle coating method, and then dried to form an electroconductive layer having a thickness of 20 μm on the both edges of the charge transport layer. The electroconductive layer was formed to ground the photoreceptor.

Then the sheet photoreceptor was cut to form a sheet having a width of 300 mm and a length of 400 mm in which each of the edges having a length of 400 mm had an electroconductive layer. The edges having a length of 300 mm were connected by a supersonic welding method.

Thus, an endless photoreceptor belt of Example 1 was prepared.

Example 2

The procedure for preparation of the photoreceptor in Example 1 was repeated except that the Z-form polycarbonate in the charge transport layer coating liquid was replaced with an A-form polycarbonate.

Thus, an endless photoreceptor belt of Example 2 was prepared.

Example 3

The procedure for preparation of the photoreceptor in Example 1 was repeated except that the addition amount of the silicone oil in the charge transport layer coating liquid was changed to 0.001 parts.

Thus, an endless photoreceptor belt of Example 3 was prepared.

Example 4

The procedure for preparation of the photoreceptor in Example 1 was repeated except that a protective layer having a thickness of 3 μm was formed on the charge transport layer. In this case, the electroconductive layer was formed on the both edges of the protective layer.

| Formulation of protective layer | |
|---|---|
| Polycarbonate resin | 5 |
| Titanium oxide | 2 |
| Charge transport material having the following formula (3) | 3 |
| Cyclohexanone | 200 |

(3)

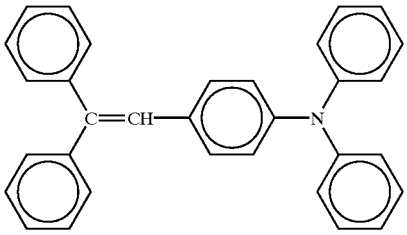

Thus, an endless photoreceptor belt of Example 4 was prepared.

Comparative Example 1

The procedure for preparation of the photoreceptor in Example 1 was repeated except that the charge transport material in the charge transport layer coating liquid was replaced with a butadiene compound having the following formula (4).

(4)

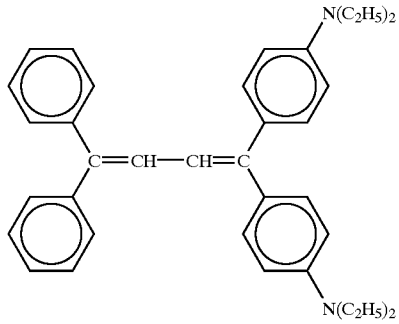

Thus, an endless photoreceptor belt of Comparative Example 1 was prepared.

Comparative Example 2

The procedure for preparation of the photoreceptor in Example 1 was repeated except that the following second charge transport layer coating liquid was coated on the (first) charge transport layer and dried to form a second charge transport layer having a thickness of about 5 μm on the (first) charge transport layer.

| Formulation of second charge transport layer | |
|---|---|
| Polycarbonate resin (PANLITE TS-2050 manufactured by Teijin Ltd.) | 5 |
| Charge transport material having the following formula (5) | 3 |
| Tetrahydrofuran | 40 |
| Cyclohexanone | 140 |

(5)

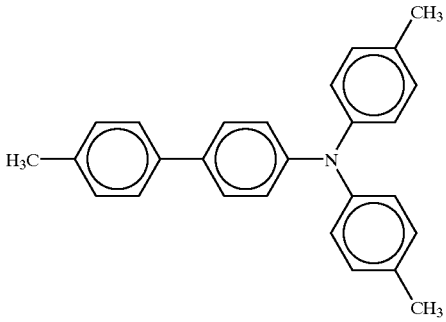

Thus, an endless photoreceptor belt of Comparative Example 2 was prepared.

Each of the photoreceptors of Examples 1 to 4 and Comparative Examples 1 and 2 was evaluated as follows:

A. Static Friction Coefficient

The static friction coefficient of the surface of the photosensitive layer side of a photoreceptor was measured by an Euler belt method. The Euler belt method will be explained.

Figure 4:
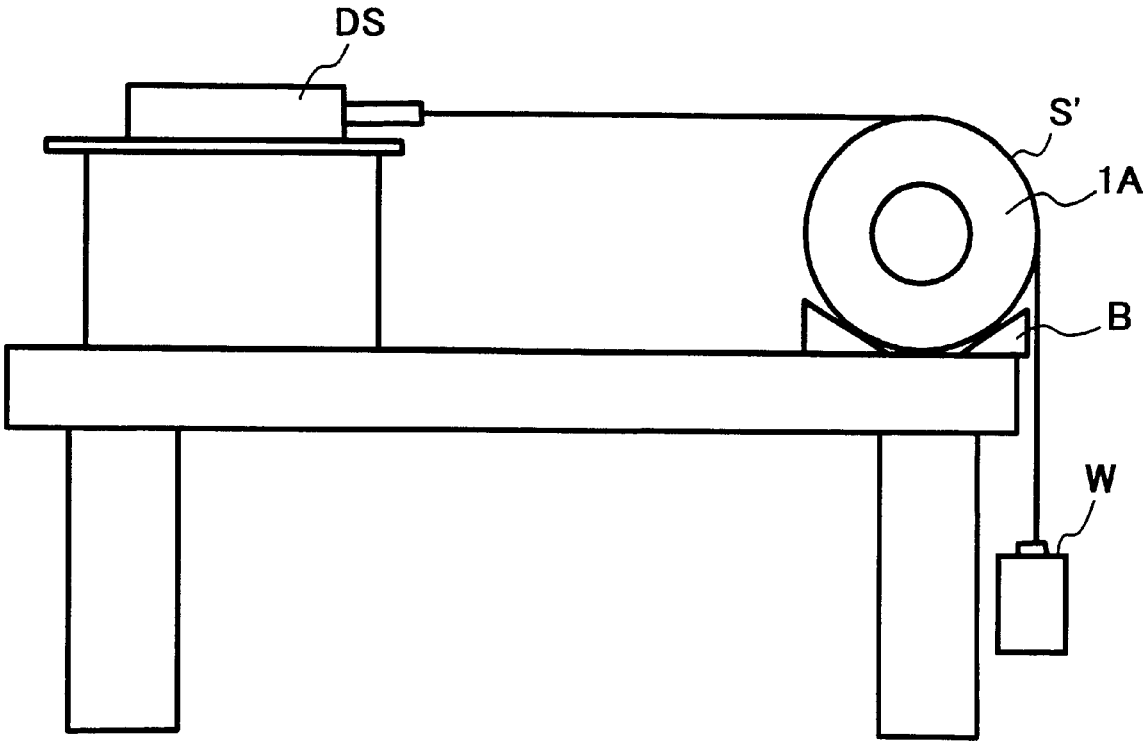
FIG. 4 is a schematic view illustrating a friction coefficient measuring instrument using an Euler belt method.

The measuring instrument for use in the Euler belt method is shown in FIG. 4.

A character S' denotes a paper to be measured which have a middle thickness. Two hooks are set at each end of the paper S', and a load w (100 g) is set at one hook and a digital force gauge DS is set at the other hook. The paper S' is set in the measuring instrument so as to contact a photoreceptor 1A which is held by a block B, as shown in FIG. 4. The paper S' is pulled with the digital force gauge DS. Provided when a force at which the paper S' starts to move is F, the coefficient of static friction of the photoreceptor 1A is determined by the following equation:

$$\mu s=(\pi/2)ln(F/w)$$

wherein $\mu s$ is the coefficient of static friction of the photoreceptor 1A, F is the measured value of the force, and w is the load (gram-force).

B. Running Test (Abrasion of Photosensitive Layer (or Protective Layer))

An endless photoreceptor belt was set in a belt driving tester having a configuration as shown in FIG. 3. A stainless steel (SUS) roller having a static friction coefficient of 0.410 was used as the roller 70. The photoreceptor was run in a length such that 20,000 copies of A3 size could be produced. The thickness difference of the photoreceptor before and after the running test was measured using a digital electronic microscope manufactured by Anritsu Corp.

C. Electrophotographic Properties

The photoreceptor which had been subjected to the running test in paragraph B was set in an electrophotographic property analyzer (EPA8100 manufactured by Kawaguchi Electric Works) to evaluate the electrophotographic properties thereof. The procedures are as follows:

(1) a photoreceptor is set on a turn table and charged while rotated and performing corona discharging by applying −6KV thereto for 20 seconds to measure a maximum surface potential Vm (−V) of the photoreceptor;

(2) the surface potential $V_0$ (−V) of the photoreceptor is measured at a time 20 seconds after stopping the corona discharging while the photoreceptor is rotated, to evaluate dark decay rate ($V_0/V_m$);

(3) then the photoreceptor is exposed to light having a wavelength of 660 nm and a light quantity of 5.0 $\mu W/cm^2$ for 30 seconds to measure a residual potential V30 (−V) and a light quantity ($E_{1/2}$) ($\mu J/cm^2$) needed for reducing the surface potential $V_0$ to one half.

In addition, the photoreceptor was subjected to the following fatigue test:

1) the photoreceptor is set on a turn table of another electrophotographic property analyzer;

2) the photoreceptor is repeatedly subjected to a combination of a light irradiation process using a tungsten light and a corona discharging process while controlling light quantity and corona discharge voltage conditions such that the photoreceptor has a surface potential of −800 V and the charging current is 5.6 $\mu$A for 2 hours; and 3) the electrophotographic properties (i.e., $V_0/V_m$, V30 and $E_{1/2}$) of the fatigued photoreceptor are determined by the method mentioned above.

D. Pencil Hardness of the Photoreceptor

The pencil hardness of the surface of each photoreceptor was measured based on JIS K5400 mentioned above.

The results are shown in Table 1 and 2.

TABLE 1

| | Friction coefficient | Abrasion quantity ($\mu$m) | Pencil hardness |
|---|---|---|---|
| Ex. 1 | 0.216 | 0.1 | 3H |
| Ex. 2 | 0.234 | 0.5 | 3H |
| Ex. 3 | 0.225 | 0.2 | 4H |
| Ex. 4 | 0.283 | 0.6 | 3H |

TABLE 1-continued

| | Friction coefficient | Abrasion quantity ($\mu$m) | Pencil hardness |
|---|---|---|---|
| Comp. Ex. 1 | 0.561 | 2.5 | 2H |
| Comp. Ex. 2 | 0.482 | 2.4 | 2H |

TABLE 2

| | Vm (−V) | $V_0$ (−V) | $V_0$/Vm | V30 (−V) | $E_{1/2}$ ($\mu J/cm^2$) |
|---|---|---|---|---|---|
| Ex. 1 | 1596 | 1475 | 0.924 | 51 | 0.58 |
| Ex. 2 | 1548 | 1402 | 0.906 | 60 | 0.57 |
| Ex. 3 | 1544 | 1372 | 0.888 | 42 | 0.60 |
| Ex. 4 | 1582 | 1451 | 0.917 | 51 | 0.57 |
| Comp. Ex. 1 | 1231 | 903 | 0.734 | 83 | 0.75 |
| Comp. Ex. 2 | 1307 | 948 | 0.726 | 102 | 0.81 |

As can be understood from Tables 1 and 2, the photoreceptor of the present invention (i.e., the photoreceptors of Examples 1 to 4) has good abrasion resistance and good electrophotographic properties even when repeatedly used. In contrast, the comparative photoreceptors of Comparative Examples 1 and 2 has poor abrasion resistance and in addition the electrophotographic properties thereof deteriorate when the photoreceptors are repeatedly used.

This document claims priority and contains subject matter related to Japanese Patent Application No. 2001-060790, filed on Mar. 5, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic image bearer comprising:

a belt-form electrophotographic photoreceptor comprising an electroconductive substrate and a photosensitive layer located overlying the substrate and optionally a protective layer located overlying the photosensitive layer; and a pressing member which presses the belt-form photoreceptor while a surface of the pressing member contacts a surface of the photosensitive layer side of the belt-form photoreceptor such that the belt-form photoreceptor has a U-form portion, wherein the pressing member is rotated by the belt-form photoreceptor, wherein the surface of the photosensitive layer side of the belt-form photoreceptor has a static friction coefficient less than a static friction coefficient of the surface of the pressing member.

2. The electrophotographic image bearer according to claim 1, wherein the static friction coefficient of the surface of the photosensitive layer side of the belt-form photoreceptor is from 0.1 to 0.4.

3. The electrophotographic image bearer according to claim 1, wherein the surface of the photosensitive layer side of the belt-form photoreceptor has a pencil hardness of 3H or harder.

4. The electrophotographic image bearer according to claim 1, wherein the photosensitive layer comprises a charge generation layer and a charge transport layer.

5. The electrophotographic image bearer according to claim 1, wherein the charge transport layer comprises a charge transport material and a binder resin.

6. The electrophotographic image bearer according to claim 5, wherein the charge transport layer further comprises an antioxidant.

7. The electrophotographic image bearer according to claim 4, wherein the photosensitive layer has a thickness of from 10 μm to 30 μm.

8. The electrophotographic image bearer according to claim 1, wherein the belt-form photoreceptor has a peripheral length of from 100 mm to 5,000 mm.

9. The electrophotographic image bearer according to claim 1, wherein the belt-form photoreceptor has a thickness of from 80 μm to 160 μm.

10. An electrophotographic image forming apparatus comprising:

an image bearer comprising a belt-form photoreceptor and a pressing member;

a charger configured to charge the belt-form photoreceptor;

a light irradiator configured to irradiate the belt-form photoreceptor with laser light to form an electrostatic latent image on the belt-form photoreceptor;

an image developer configured to develop the latent image with a developer including a toner to form a toner image on the belt-form photoreceptor; and an image trans ferer configured to transfer the toner image onto a receiving material, wherein the image bearer is the electrophotographic image bearer according to claim 1.

11. The electrophotographic image forming apparatus according to claim 10, wherein the static friction coefficient of the surface of the photosensitive layer side of the belt-form photoreceptor is from 0.1 to 0.4.

12. The electrophotographic image forming apparatus according to claim 10, wherein the surface of the photosensitive layer side of the belt-form photoreceptor has a pencil hardness of 3H or harder.

13. The electrophotographic image forming apparatus according to claim 10, wherein the photosensitive layer comprises a charge generation layer and a charge transport layer.

14. The electrophotographic image forming apparatus according to claim 10, wherein the charge transport layer comprises a charge transport material and a binder resin.

15. The electrophotographic image forming apparatus according to claim 14, wherein the charge transport layer further comprises an antioxidant.

16. The electrophotographic image forming apparatus according to claim 13, wherein the photosensitive layer has a thickness of from 10 μm to 30 μm.

17. The electrophotographic image forming apparatus according to claim 10, wherein the belt-form photoreceptor has a peripheral length of from 100 mm to 5,000 mm.

18. The electrophotographic image forming apparatus according to claim 10, wherein the belt-form photoreceptor has a thickness of from 80 μm to 160 μm.

19. A process cartridge comprising:

an electrophotographic image bearer; and at least one of a charger, an image irradiator, an image developer, an image transferer, a cleaner and a discharger, wherein the electrophotographic image bearer is the electrophotographic image bearer according to claim 1.

20. The process cartridge according to claim 19, wherein the static friction coefficient of the surface of the photosensitive layer side of the belt-form photoreceptor is from 0.1 to 0.4.

* * * * *